US009227443B2

(12) United States Patent
Matsunaga

(10) Patent No.: US 9,227,443 B2
(45) Date of Patent: Jan. 5, 2016

(54) IMAGE RECORDING APPARATUS

(71) Applicant: Keiichi Matsunaga, Seto (JP)

(72) Inventor: Keiichi Matsunaga, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/973,023

(22) Filed: Aug. 22, 2013

(65) Prior Publication Data

US 2014/0055529 A1 Feb. 27, 2014

(30) Foreign Application Priority Data

Aug. 22, 2012 (JP) ..... 2012-183225

(51) Int. Cl.
*B41J 2/16* (2006.01)
*B41J 25/304* (2006.01)
*B41J 19/00* (2006.01)

(52) U.S. Cl.
CPC ..... *B41J 25/304* (2013.01); *B41J 19/005* (2013.01)

(58) Field of Classification Search
CPC ..... B41J 25/304
USPC ..... 347/10, 14, 37
See application file for complete search history.

(56) References Cited

U.S. PATENT DOCUMENTS 6,413,103 B1 * 7/2002 Merz et al. ..... 439/98
7,768,798 B2 * 8/2010 Aono et al. ..... 361/818
2008/0185167 A1 * 8/2008 Lee ..... 174/117 F
2011/0181643 A1 * 7/2011 Yamashita ..... 347/10
2011/0186324 A1 * 8/2011 Hur et al. ..... 174/34
2012/0020416 A1 * 1/2012 Shimura et al. ..... 375/257

FOREIGN PATENT DOCUMENTS

JP 2000-181591 A 6/2000
JP 2005-156952 A 6/2005
JP 2010-200231 A 9/2010

OTHER PUBLICATIONS

Luiz de Paula, et al. p. 522, "Comparative Study of the Teflon® Electromagnetic Parameters (permittivity and Permeability) Experimentally Obtained and Numerically Simulated," Microwave and Optoelectronics Conference (IMOC), 2009, p. 519-22.*
Jan. 29, 2015—(CN) Notification of First Office Action—App 201310369918.9, Eng Tran.

* cited by examiner

*Primary Examiner* — Matthew Luu
*Assistant Examiner* — Patrick King
(74) *Attorney, Agent, or Firm* — Banner & Witcoff, Ltd.

(57) ABSTRACT

A recording head is configured to selectively eject ink droplets from nozzles. A head board is configured to control the recording head to operate based on a high-frequency signal outputted from a control board. A carriage is configured to move in a reciprocating manner, with the recording head and the head board mounted thereon. A belt-like cable connects the control board and the head board so that the high-frequency signal can be transmitted therebetween. The cable has such flexibility that the cable can change a posture following reciprocating movement of the carriage. The cable has a first surface facing in a thickness direction of the cable. The cable has a reflective layer at a part of each of both end portions of the first surface with respect to a longitudinal direction of the first surface. The reflective layer is configured to reflect an electromagnetic wave.

11 Claims, 10 Drawing Sheets

IMAGE RECORDING APPARATUS

CROSS REFERENCE TO RELATED APPLICATIONS

This application claims priority from Japanese Patent Application No. 2012-183225 filed Aug. 22, 2012. The entire content of the priority application is incorporated herein by reference.

TECHNICAL FIELD

The invention relates to an image recording apparatus that records an image on a recording medium by ejecting ink droplets from a recording head, and more specifically to an inkjet-type image recording apparatus that supplies the recording head with ink from an ink supply via an ink supplying tube.

BACKGROUND

An inkjet recording apparatus is known that ejects ink droplets from a recording head to perform image recording on a recording medium such as recording paper. In the inkjet recording apparatus, the recording head is mounted on a carriage, and the recording head, the carriage, and the like constitute a recording section. A driving source such as a motor transmits driving force to the carriage so that the carriage moves reciprocatingly in a certain direction. While the carriage moves reciprocatingly, the recording head ejects ink droplets onto the recording medium. With this operation, an image is formed on the recording medium.

SUMMARY

A control board that controls operations of the entire apparatus and a head board that operates the recording head in accordance with controls of the control board are mounted on the above-described inkjet recording apparatus. The control board is fixed to a casing of the inkjet recording apparatus. On the other hand, the head board is mounted on the carriage to move reciprocatingly together with the carriage. Hence, the control board and the head board are electrically connected via a flexible flat cable (FFC). The FFC is a belt-like signal line having such flexibility that the posture of the FFC can change following reciprocating movement of the carriage. Hence, the FFC can electrically connect the control board and the head board without hindering reciprocating movement of the carriage.

Further, with speeding-up of a signal speed from the control board to the head board in recent years, transmission of control signals in the low voltage differential signaling (LVDS) method has been attracting attention. However, harmonic waves formed by performing Fourier series expansion on LVDS signals have higher frequency than the single-end method or the like. Thus, there is a problem that radiation noise radiated from the FFC increases during data transmission.

Hence, as an example of solving the above-mentioned problem, an FFC is proposed that includes a first portion in which an electrically-conductive film is affixed to a first surface confronting a metal frame, and a second portion in which an electrically-conductive film is affixed to a second surface at the opposite side of the surface confronting the metal frame.

There are various causes of generation of radiation noise due to high-frequency signals, and further suppression of radiation noise is required recently. Also, in the above-described method, because an electrically-conductive film is affixed to a portion that greatly bends following reciprocating movement of the carriage, there is a possibility that posture changes of the FFC are hindered.

In view of the foregoing, it is an object of the invention to provide an image recording apparatus having a cable that suppresses radiation noise due to transmission of high-frequency signals and that can change its posture smoothly.

In order to attain the above and other objects, the invention provides an image recording apparatus. The image recording apparatus includes a control board, a recording head, a head board, a carriage, and a belt-like cable. The recording head is configured to selectively eject ink droplets from nozzles. The head board is configured to control the recording head to operate based on a high-frequency signal outputted from the control board. The carriage is configured to move in a reciprocating manner, with the recording head and the head board mounted thereon. The belt-like cable connects the control board and the head board so that the high-frequency signal can be transmitted therebetween. The cable has such flexibility that the cable can change a posture following reciprocating movement of the carriage. The cable has a first surface facing in a thickness direction of the cable. The cable has a reflective layer at a part of each of both end portions of the first surface with respect to a longitudinal direction of the first surface. The reflective layer is configured to reflect an electromagnetic wave.

BRIEF DESCRIPTION OF THE DRAWINGS

Embodiments in accordance with the invention will be described in detail with reference to the following figures wherein.

DETAILED DESCRIPTION

Figure 1:
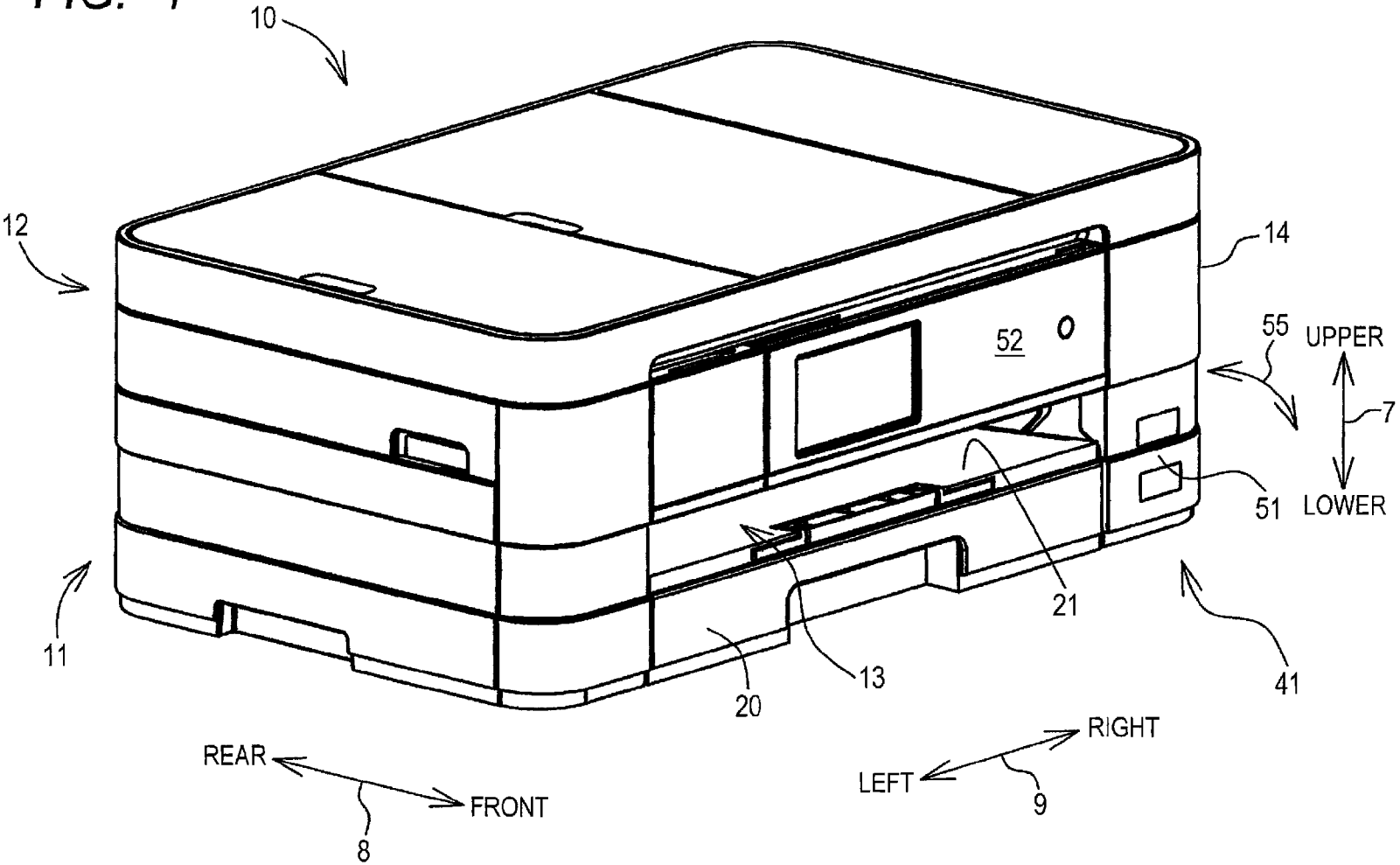
FIG. 1 is a perspective view of an appearance of a multi-function peripheral according to an embodiment.

An embodiment of the invention will be described while referring to FIGS. 1 through 10B. In the following description, an upper-lower direction 7 is defined in a state where a multifunction peripheral 10 is disposed in an orientation in which it is intended to be used (the orientation shown in FIG. 1). A front-rear direction 8 is defined so that a side formed with a main-body opening 13 is a near side (front side). A left-right direction 9 is defined in a state where the multifunction peripheral 10 is viewed from the near side (front side).

[Multifunction Peripheral 10]

As shown in FIG. 1, the multifunction peripheral 10 is formed in a substantially rectangular-parallelepiped shape. The multifunction peripheral 10 includes, at its upper part, a scanner section 12 that reads, with an image sensor, an image recorded on an original document such as recording paper, and that acquires image data. Also, the multifunction peripheral 10 includes, at its lower part, a printer section 11 that records an image on recording paper 15 (see FIG. 2) based on image data or the like. The multifunction peripheral 10 has a casing 14 formed with the main-body opening 13 at the front side thereof. A paper feed tray 20 and a paper discharge tray 21 can be inserted or removed through the main-body opening 13 in the front-rear direction 8. Sheets of recording paper 15 in a desired size are stacked in the paper feed tray 20.

The scanner section 12 is a so-called flatbed scanner. Here, descriptions of the scanner section 12 are omitted.

Figure 2:
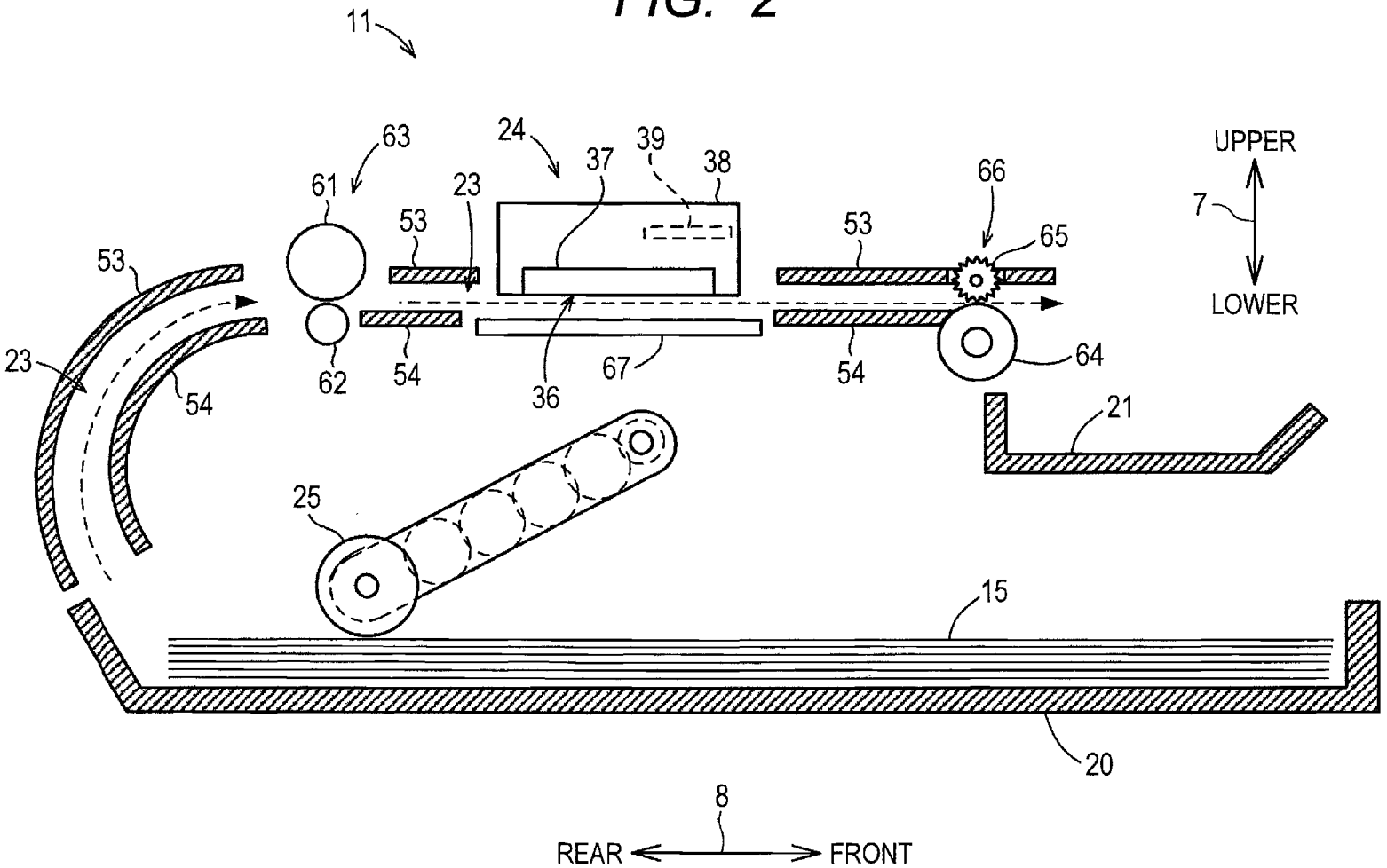
FIG. 2 is a vertical cross-sectional view schematically showing the internal structure of a printer section.

As shown in FIG. 2, the printer section 11 includes a conveying path 23, a paper feeding roller 25, a pair of conveying rollers 63, a pair of discharging rollers 66, and an inkjet-recording-type recording section 24. The paper feeding roller 25 feeds the recording paper 15 stacked on the paper feed tray 20 to the conveying path 23. The pair of conveying rollers 63 and the pair of discharging rollers 66 are provided on the conveying path 23, and convey the recording paper 15 fed to the conveying path 23 by the paper feeding roller 25. The recording section 24 records an image on the recording paper 15, based on image data etc. read from the original document by the scanner section 12.

[Conveying Path 23]

As shown in FIG. 2, the conveying path 23 is a path that starts from the rear end of the paper feed tray 20, that extends from the lower side to the upper side in a U-turn, that extends forward and passes below the recording section 24, and that reaches the paper discharge tray 21. The conveying path 23 is a space defined by outer guide members 53 and inner guide members 54 that confront each other with a predetermined interval therebetween. The recording paper 15 is conveyed along the conveying path 23 in a conveying direction that is indicated by the arrows in the dashed lines in FIG. 2.

[Pair of Conveying Rollers 63 and Pair of Discharging Rollers 66]

As shown in FIG. 2, the pair of conveying rollers 63 having a conveying roller 61 and a pinching roller 62 is provided on the conveying path 23 at an upstream side of the recording section 24 in the conveying direction. The pinching roller 62 is pressed against a roller surface of the conveying roller 61 by an elastic member such as a spring (not shown). With this configuration, the pair of conveying rollers 63 can nippingly hold the recording paper 15.

The pair of discharging rollers 66 having a discharging roller 64 and a spur 65 is provided on the conveying path 23 at a downstream side of the recording section 24 in the conveying direction. The spur 65 is pressed against a roller surface of the discharging roller 64 by an elastic member such as a spring (not shown). With this configuration, the pair of discharging rollers 66 can nippingly hold the recording paper 15.

Rotational driving force of a conveying motor (not shown) is transmitted to the conveying roller 61 and the discharging roller 64 via a driving transmission mechanism (not shown) having a planetary gear etc., thereby driving the conveying roller 61 and the discharging roller 64. Each of the conveying roller 61 and the discharging roller 64 to which the rotational driving force is transmitted conveys the recording paper 15 in the conveying direction, while nipping the recording paper 15 between the conveying roller 61 and pinching roller 62 and between the discharging roller 64 and the spur 65.

[Recording Section 24]

As shown in FIG. 2, the recording section 24 is disposed above the conveying path 23. The recording section 24 includes an inkjet-type recording head 37, a head board 39, and a carriage 38. The head board 39 causes the recording head 37 to operate in accordance with controls of a control board 80 described later. The recording head 37 and the head board 39 are mounted on the carriage 38.

As shown in FIGS. 3 through 6, the carriage 38 is supported by guide rails 43 and 44 described below, such that the carriage 38 is movable in the left-right direction 9 perpendicular to the front-rear direction 8 which is the conveying direction of the recording paper 15. In other words, the carriage 38 is supported by the pair of guide rails 43 and 44 so as to be movable in a direction along an image recording surface of the recording paper 15.

The guide rails 43 and 44 are arranged to be parallel to each other and to be spaced away from each other in the front-rear direction 8. Each of the guide rails 43 and 44 extends in the left-right direction 9. The guide rails 43 and 44 are attached to a frame 72 that supports each member constituting the printer section 11. The carriage 38 is straddlingly disposed on the guide rails 43 and 44, so as to be movable in the left-right direction 9.

A drive pulley 47 (see FIG. 6), a follow pulley 48 (see FIG. 5), and an endless belt 49 (see FIGS. 5 and 6) are arranged on the upper surface of the guide rail 44. The drive pulley 47 and the follow pulley 48 are provided near the both ends of the guide rail 44 in the left-right direction 9. The endless belt 49 is looped around the drive pulley 47 and follow pulley 48, such that the endless belt 49 is stretched between the drive pulley 47 and the follow pulley 48. A shaft of the drive pulley 47 is connected to a driving shaft of a carriage motor (not shown) for driving the carriage 38. When rotational driving force of the carriage motor is transmitted to the drive pulley 47, rotations of the drive pulley 47 cause the belt 49 to move circularly.

The lower side (bottom side) of the carriage 38 is connected to the belt 49. Thus, circular movement of the belt 49 causes the carriage 38 to move along the guide rails 43 and 44 in the left-right direction 9. That is, the carriage 38 and, the recording head 37 and the head board 39 mounted on the carriage 38 move integrally in the left-right direction 9.

As shown in FIG. 2, the recording head 37 is provided at the lower side of the carriage 38. The lower surface of the recording head 37 is formed with a plurality of nozzles (not shown). The nozzles are exposed on the lower surface of the carriage 38. That is, the recording head 37 has a nozzle surface 36 formed with the nozzles. The head board 39 is covered by a lid (not shown) that is fixed to the upper surface of the carriage 38 and that covers the upper surface of the carriage 38. The head board 39 includes a printed circuit board (not shown) and a microcomputer and various electronic parts (control circuits) mounted on the printed circuit board.

[Frame 72 and Plate 70]

Figure 3:
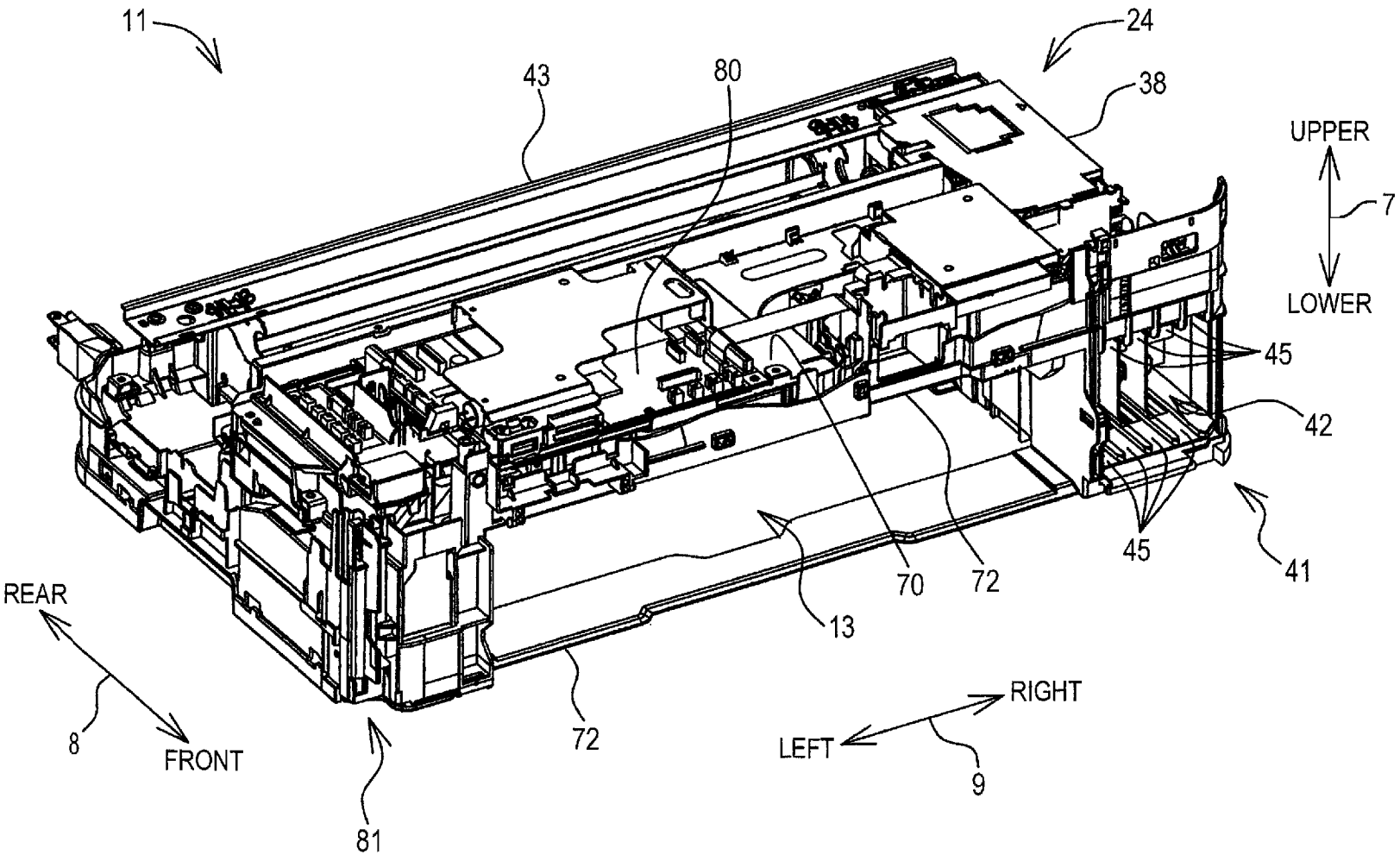
FIG. 3 is a perspective view showing the inside of the printer section, as viewed from diagonally upper left front.
Figure 4:
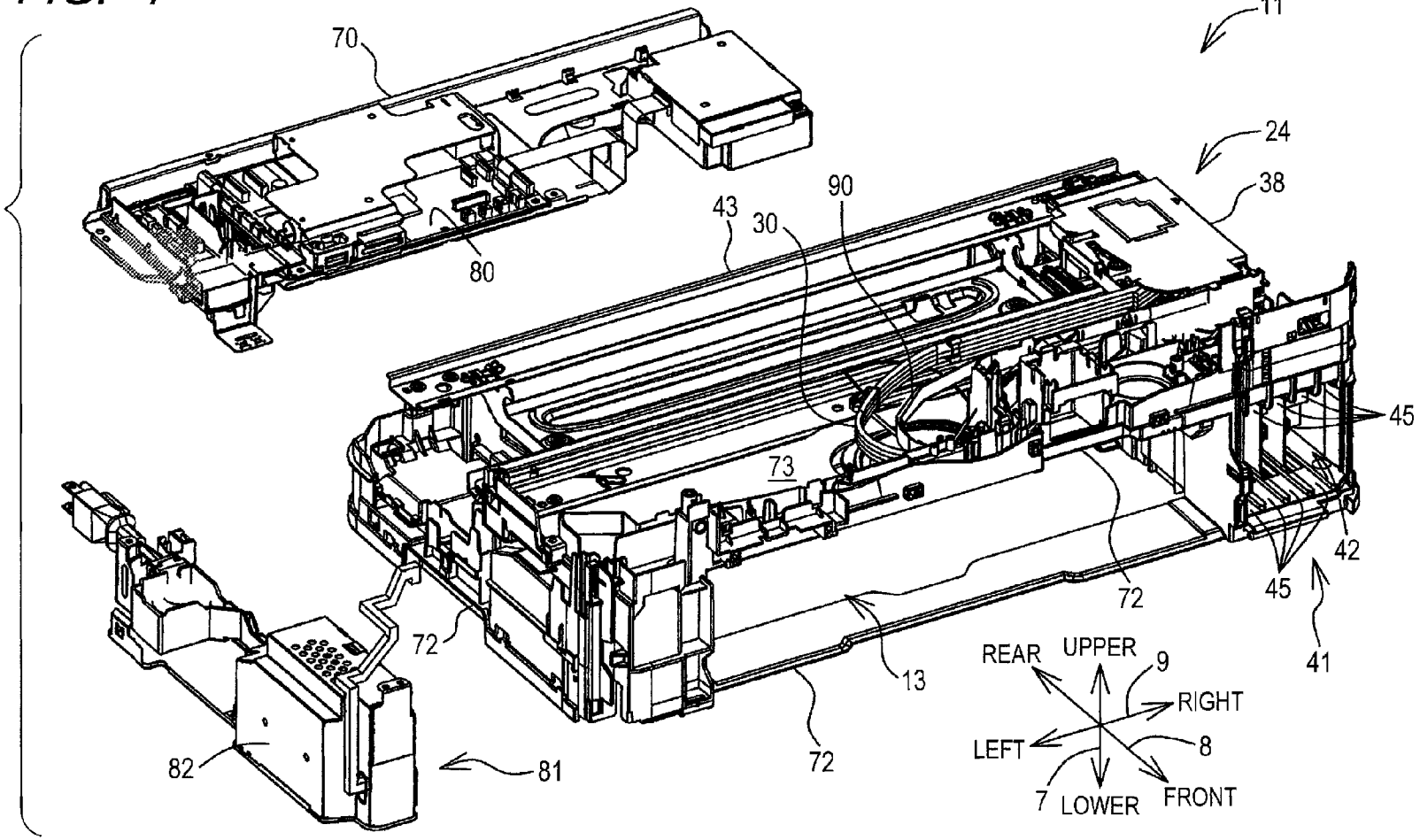
FIG. 4 is an exploded perspective view showing the inside of the printer section shown in FIG. 3.
Figure 5:
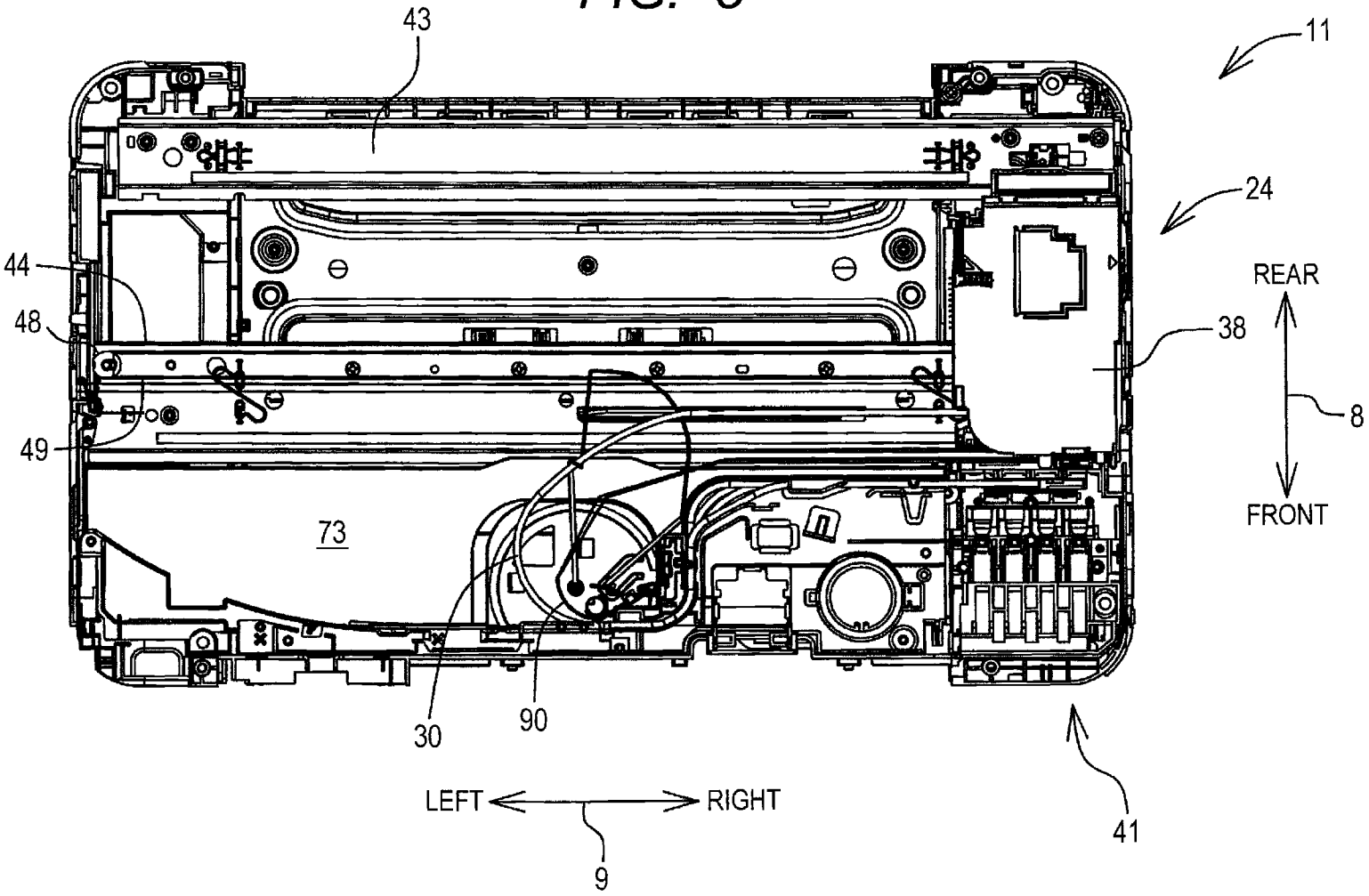
FIG. 5 is a plan view of the printer section in a state where a carriage is moved to near a right end.
Figure 6:
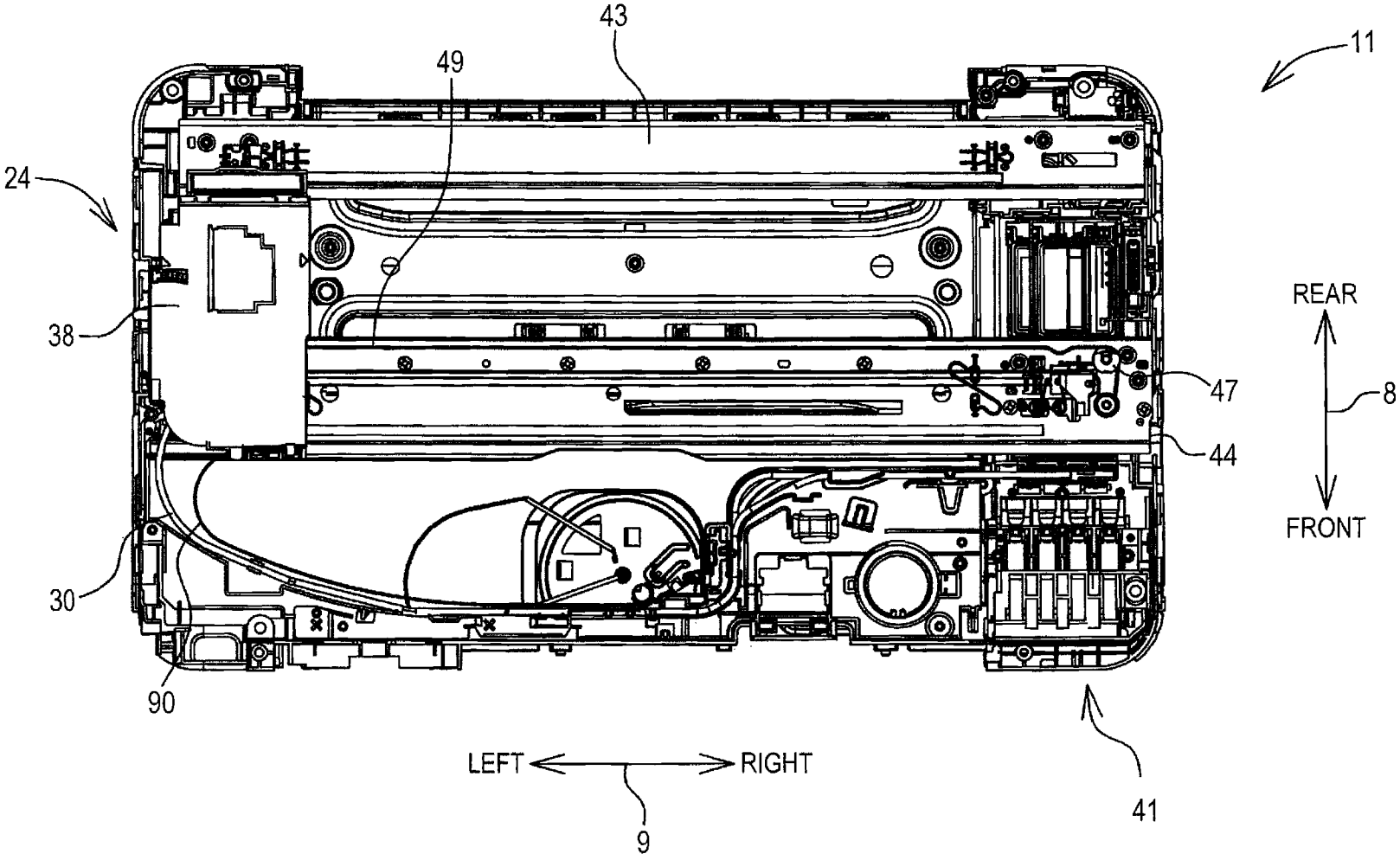
FIG. 6 is a plan view of the printer section in a state where the carriage is moved to near a left end.

As shown in FIGS. 3 and 4, the frame 72 is made of metal such as iron and stainless steel (that is, electrically-conductive material), and holds each member constituting the printer section 11. The frame 72 is a substantially rectangular-parallelepiped box-like member, of which the upper surface is opened. As shown in FIGS. 3 and 4, a plate 70 is disposed in the printer section 11, so as to cover the upper surface of the frame 72. The plate 70 is made of electrically-conductive material such as iron and stainless steel. The plate 70 is a member having a thin-plate shape in which the lengths in the front-rear direction 8 and the left-right direction 9 are longer than the length in the upper-lower direction 7. Also, the plate 70 is substantially a rectangular member in a plan view. Note that material constituting the plate 70 and the frame 72 is not limited to metal, but any electrically-conductive material can be adopted. For example, the plate 70 and the frame 72 may be made of electrically-conductive resin material.

[Control Board 80]

As shown in FIGS. 3 and 4, the control board 80 is fixed to the upper side surface of the metal-made plate 70 with screws or the like. The control board 80 includes a printed circuit board (not shown) and a microcomputer and various electronic parts (control circuits) mounted on the printed circuit board. As shown in FIG. 4, the control board 80 is disposed to extend over substantially from the front end to the rear end of the plate 70 in the front-rear direction 8.

Hereinafter, an example of controls of operations of the multifunction peripheral 10 performed by the control board 80 will be described. The operations of the multifunction peripheral 10 are, for example, a feeding operation of the recording paper 15 by the paper feeding roller 25, a conveying operation of the recording paper 15 by the pair of conveying rollers 63 and by the pair of discharging rollers 66, a moving operation of the carriage 38 in the left-right direction 9, and the like. In the case of the above-described example, the control board 80 executes the following to control the operations of the multifunction peripheral 10. That is, the control board 80 drives the paper feeding motor (not shown) for rotating the paper feeding roller 25, thereby rotating the paper feeding roller 25. Also, the control board 80 drives the above-described conveying motor to rotate the conveying roller 61 and the discharging roller 64 constituting the respective pairs of rollers 63 and 66. Further, the control board 80 transmits a control signal (high-frequency signal) to the head board 39 to drive the above-described carriage motor, thereby ejecting ink while moving the carriage 38.

[Power-Source Board 81]

As shown in FIGS. 3 and 4, a power-source board 81 is disposed at the left-front end of the printer section 11. Note that, in FIGS. 3 and 4, the power-source board 81 includes a board main body (not shown) which is a known printed circuit board, and a cover body 82 that covers the board main body. Electronic parts and the like are mounted on the board main body, like the control board 80. Specifically, electronic parts (not shown) such as capacitors that are needed to supply electric power to electric components built in the multifunction peripheral 10 such as the control board 80 are mounted on the board main body. The electronic parts mounted on the board main body are connected to the electronic parts mounted on the control board 80 and to the above-mentioned electric components. Thus, the electronic parts mounted on the board main body can supply electric power to the electronic parts mounted on the control board 80 and the above-mentioned electric components.

[Cartridge Mounting Section 41]

As shown in FIGS. 1, 3, and 4, a cartridge mounting section 41 is provided at the right-lower portion of a front surface 52 (see FIG. 1) of the printer section 11. As shown in FIG. 1, a cover 51 is provided at the right-lower portion of the front surface 52 of the printer section 11. The cover 51 can open/close by pivotally moving in directions shown by an arrow 55 about an axis located at the lower end of the front surface 52 of the printer section 11. As shown in FIGS. 3 and 4, by opening the cover 51, the cartridge mounting section 41 is exposed.

As shown in FIGS. 3 and 4, the cartridge mounting section 41 is substantially a rectangular-parallelepiped box-like member formed with an opening 42. The cartridge mounting section 41 is attached to the casing 14 of the printer section 11 at the right side of the main-body opening 13, so that the opening 42 is located at the front side.

Ink cartridges (not shown) are inserted into and removed from the cartridge mounting section 41 through the opening 42. Guide grooves 45 are formed on a ceiling surface and a bottom surface of the cartridge mounting section 41. The ink cartridges are inserted and removed along the guide grooves 45. In the present embodiment, the four guide grooves 45 are formed on each of the ceiling surface and the bottom surface of the cartridge mounting section 41. In the present embodiment, four ink cartridges for respective colors of cyan, magenta, yellow, and black can be inserted into and removed from the cartridge mounting section 41.

[Ink Supplying Tube 30]

As described above, ink cartridges storing ink of respective colors are mounted on the cartridge mounting section 41 of the printer section 11. And, as shown in FIG. 4, four ink supplying tubes 30 for ink of the respective colors are routed from the cartridge mounting section 41 to the carriage 38. The ink supplying tubes 30 routed to the carriage 38 supply the recording head 37 mounted on the carriage 38 with ink of the respective colors.

The ink supplying tubes 30 are tubes made of synthetic resin and formed in a straight shape. The ink supplying tubes 30 have appropriate elasticity (flexural rigidity) of maintaining the straight shape. That is, the ink supplying tubes 30 have flexibility of bending when external force is added, and have elasticity of returning to their original shapes when the external force is released. Due to this flexibility and elasticity, the ink supplying tubes 30 change their postures following reciprocating movement of the carriage 38.

In the above-described configuration, ink of the respective colors stored in ink chambers of the ink cartridges is supplied to the recording section 24 via the ink supplying tubes 30. And, while the carriage 38 slindingly moves, ink of the respective colors is ejected selectively from respective nozzles as minute ink droplets. With this operation, an image is recorded on the recording paper 15 that is conveyed on a platen 67 (see FIG. 2).

[Flexible Flat Cable 90]

The control board 80 and the head board 39 are electrically connected by a flexible flat cable 90. Specifically, as shown in FIGS. 7A through 8B, an end portion of the flexible flat cable 90 at the carriage 38 side is connected to the head board 39 mounted on the carriage 38. On the other hand, as shown in FIGS. 7A through 8B, an end portion of the flexible flat cable 90 at the control board 80 side is fixed to the frame 72. And, the control board 80 side of the flexible flat cable 90 is connected to the control board 80 via a harness (not shown) extending from this end portion. The flexible flat cable 90 has flexibility to change its posture following reciprocating movement of the carriage 38.

Figure 10A:
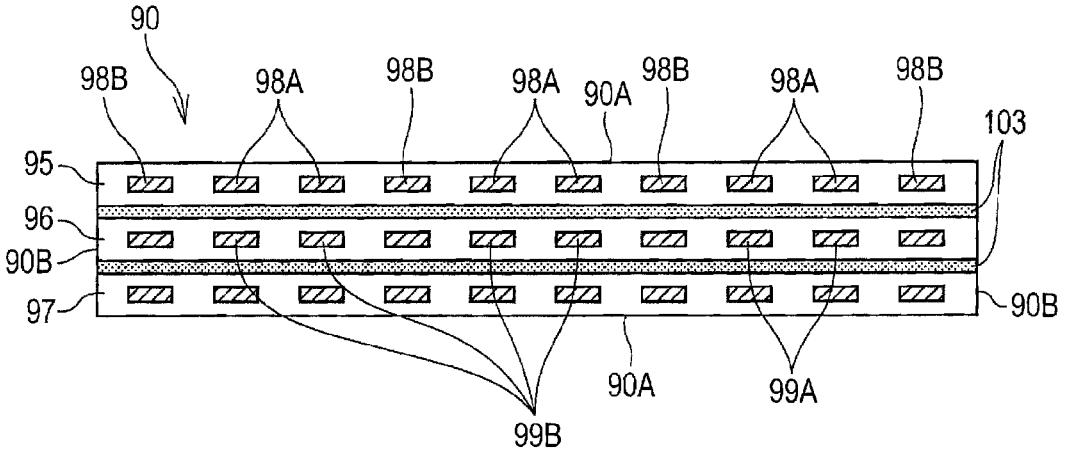
FIG. 10A is a cross-sectional view schematically showing a cross-section in end regions of the flexible flat cable.
Figure 10B:
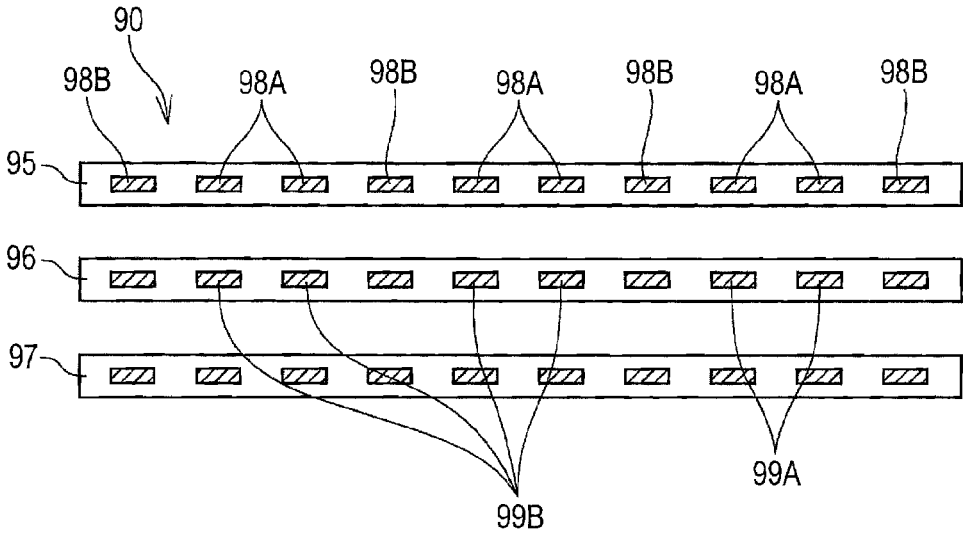
FIG. 10B is a cross-sectional view schematically showing a cross-section in a center region of the flexible flat cable.

The flexible flat cable 90 is a signal line having a thin belt-like shape that the size in the thickness direction is smaller than the size in the width direction. In the flexible flat cable 90, for example, as shown in FIGS. 10A and 10B, a plurality of conductive lines for transmitting electrical signals is arranged in the width direction, and these conductive lines are covered by synthetic resin film such as polyester film. Hereinafter, each of a pair of surfaces of the flexible flat cable 90 confronting in the thickness direction is referred to as "principal surface" 90A (FIGS. 7B and 10A), and each of a pair of surfaces of the flexible flat cable 90 confronting in the width direction is referred to as "end surface" 90B (FIGS. 7B and 10A). That is, the flexible flat cable 90 is a belt-like signal line that the area of the principal surface 90A is larger than the area of the end surface 90B. Note that the principal surface and the end surface of the flexible flat cable 90 are not necessarily a flat surface, but may be a curved surface.

As shown in FIGS. 7A through 8B, the flexible flat cable 90 is disposed within a space 73 defined by the plate 70 and the frame 72 such that the width direction of the belt-like shape is in the upper-lower direction 7, that is, the pair of end surfaces 90B faces in the upper-lower direction 7. Here, the flexible flat cable 90 is disposed in a curved state in substantially a U-shape along inner wall surfaces of the plate 70 and the frame 72. The space 73 in which the flexible flat cable 90 is disposed has substantially a rectangular-parallelepiped shape that is defined by a ceiling surface (the lower surface of the plate 70) and a bottom surface facing in the upper-lower direction 7, by a pair of side wall surfaces facing in the front-rear direction 8, and by a pair of side wall surface facing in the left-right direction 9.

Here, an expression that a direction of reciprocating movement of the carriage 38 (first direction) intersects a direction in which the end surface 90B of the flexible flat cable 90 faces (second direction) does not require that these two directions actually intersect. That is, it is only required that the first direction appears to intersect the second direction, as viewed from a direction perpendicular to the both of the first and second directions. For example, an imaginary line extending in the first direction and an imaginary line extending in the second direction may be skew lines.

Although the flexible flat cable 90 can be used as a single cable, in many cases a plurality of cables are bundled for use. In the present embodiment, as shown in FIGS. 10A and 10B, the flexible flat cable 90 is configured by layering three flexible flat cables (a first cable 95, a second cable 96, and a third cable 97) in the thickness direction (that is, so that the principal surfaces of each cable confront each other). Because the configuration of the first through third cables 95, 96, and 97 is the same as the configuration of the above-described flexible flat cable 90, repetitive descriptions will be omitted.

In the present embodiment, the control board 80 transmits a high-frequency signal in LVDS (Low Voltage Differential Signaling) method to the head board 39 through the first cable 95. On the other hand, the second cable 96 and the third cable 97 are used for transmitting electric power or a low-speed signal, for example.

Here, a rectangular wave of LVDS is formed, for example, by superimposing a fundamental wave of 48 MHz and a plurality of harmonic waves (for example, 144 MHz, 192 MHz, and 240 MHz). When such a high-frequency signal is transmitted through the first cable 95, a measure against radiation noise radiated from the first cable 95 is needed. Hence, the measure against radiation noise in the present embodiment will be described in detail while referring to FIGS. 7A through 10B.

First, the flexible flat cable 90 vibrates when the carriage 38 moves in a reciprocating manner. Thus, in order to prevent the flexible flat cable 90 from contacting the surrounding electrically-conductive wall surfaces, an insulating layer is provided on a surface of the plate 70 or the frame 72 confronting the pair of end surfaces of the flexible flat cable 90.

Figure 7A:
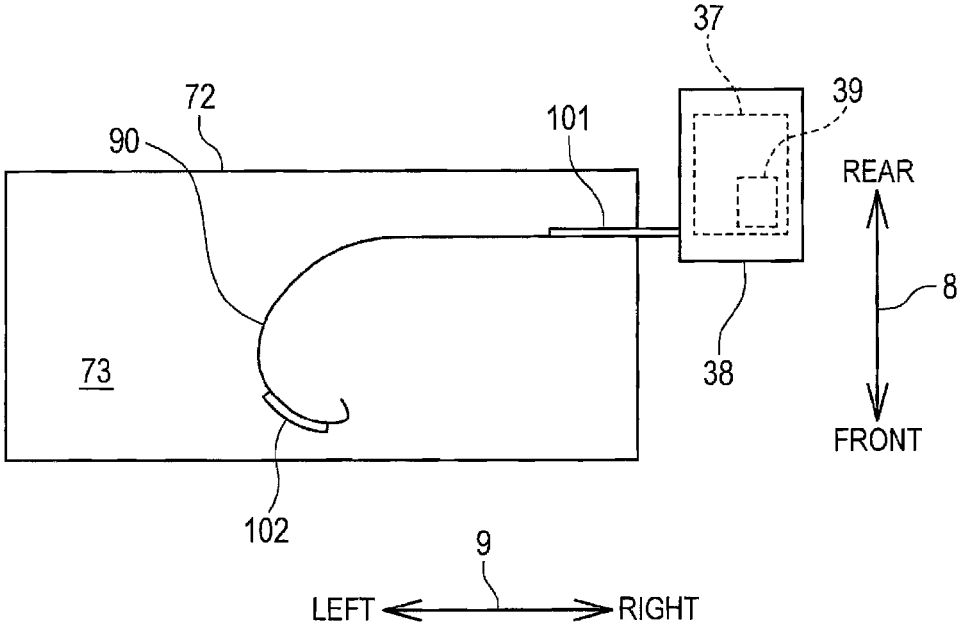
FIG. 7A is a plan view schematically showing the positional relationship between the carriage and a flexible flat cable in a state where the carriage is moved to near the right end.
Figure 7B:
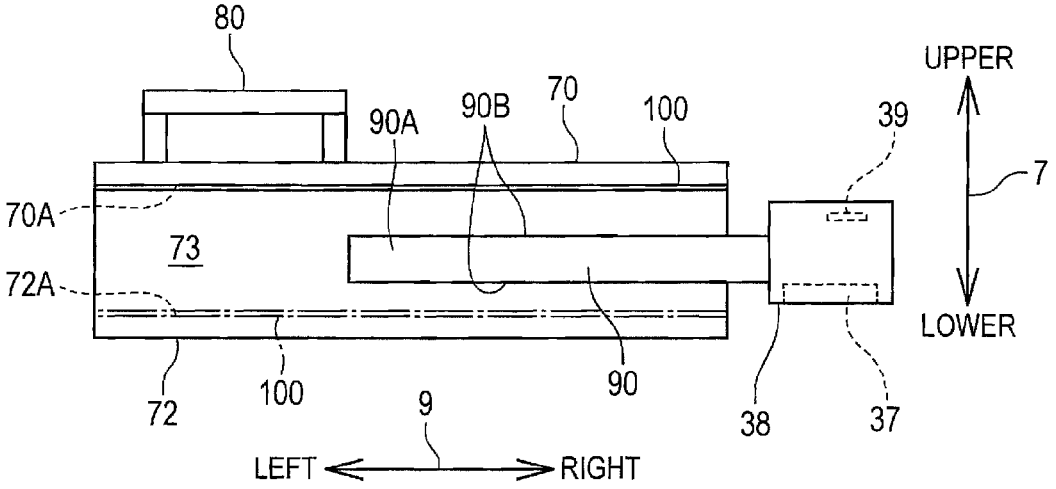
FIG. 7B is a front view schematically showing the positional relationship between the carriage and the flexible flat cable in the state where the carriage is moved to near the right end.
Figure 8A:
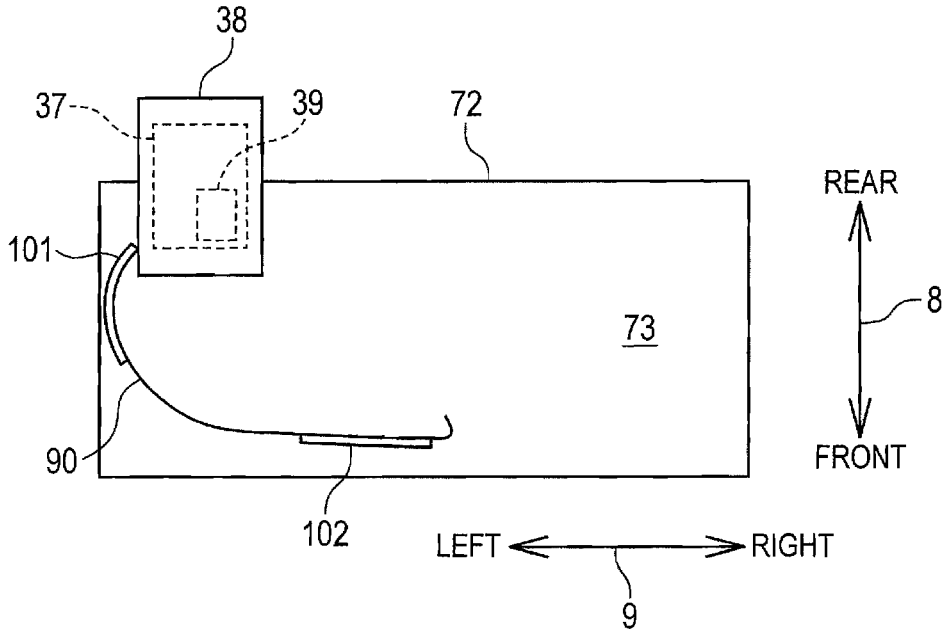
FIG. 8A is a plan view schematically showing the positional relationship between the carriage and the flexible flat cable in a state where the carriage is moved to near the left end.
Figure 8B:
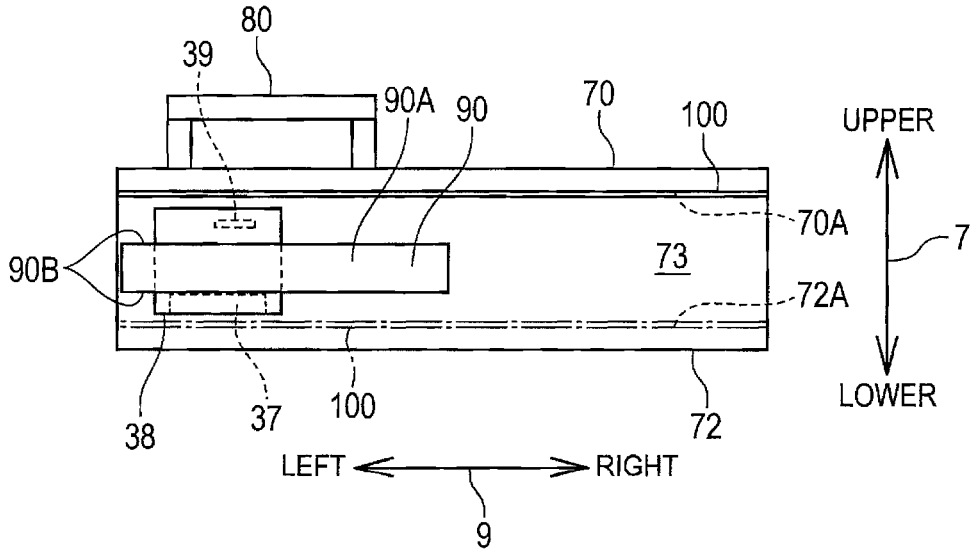
FIG. 8B is a front view schematically showing the positional relationship between the carriage and the flexible flat cable in the state where the carriage is moved to near the left end.

In the present embodiment, as shown in FIGS. 7B and 8B, an insulating sheet 100 is affixed to a surface 70A confronting the end surface 90B of the flexible flat cable 90 facing upward (that is, the lower surface 70A of the plate 70 or the ceiling surface defining the space 73). For example, the insulating sheet 100 is made by forming insulating material such as resin in a sheet shape, and is affixed to the plate 70 with adhesive or the like.

In the example of FIGS. 7B and 8B, the insulating sheet 100 is affixed only to the lower surface 70A of the plate 70. However, instead of this insulating sheet 100 or in addition to this insulating sheet 100, the insulating sheet 100 may be affixed to an inner wall surface 72A of the frame 72 confronting the end surface 90B of the flexible flat cable 90 facing downward (the bottom surface defining the space 73), as indicated by the single-dot chain lines in FIGS. 7B and 8B. That is, the insulating sheet 100 is provided on at least one of the surfaces 70A and 72A of the plate 70 and the frame 72 confronting the end surfaces 90B of the flexible flat cable 90.

Further, although an example has been described in which the insulating sheet 100 is affixed in the present embodiment, a method of forming an insulating layer is not limited to this. For example, insulating material may be applied to the surface confronting the end surface of the flexible flat cable 90, or an insulating film may be formed with another surface treatment method. That is, with respect to the insulating layer of the invention, a form (sheet, thin film, etc.) and a forming method (affixing, applying, etc.) do not matter, and it is merely required that the insulating layer can prevent the flexible flat cable 90 from directly contacting surrounding electrically-conductive wall surfaces.

Next, a loop of common-mode noise is formed between the principal surface 90A of the flexible flat cable 90 and the inner wall surface of the frame 72 confronting this principal surface 90A. In order to reduce the loop area of this common-mode noise, an electrically-conductive sheet is affixed to parts of both end portions of the flexible flat cable 90 in the longitudinal direction, out of the principal surface 90A of the flexible flat cable 90 confronting the inner wall surface of the frame 72. The electrically-conductive sheet at least reflects electromagnetic waves (has electromagnetic-wave reflecting capability), and preferably, further absorbs electromagnetic waves (has electromagnetic-wave absorbing capability).

Figure 9:
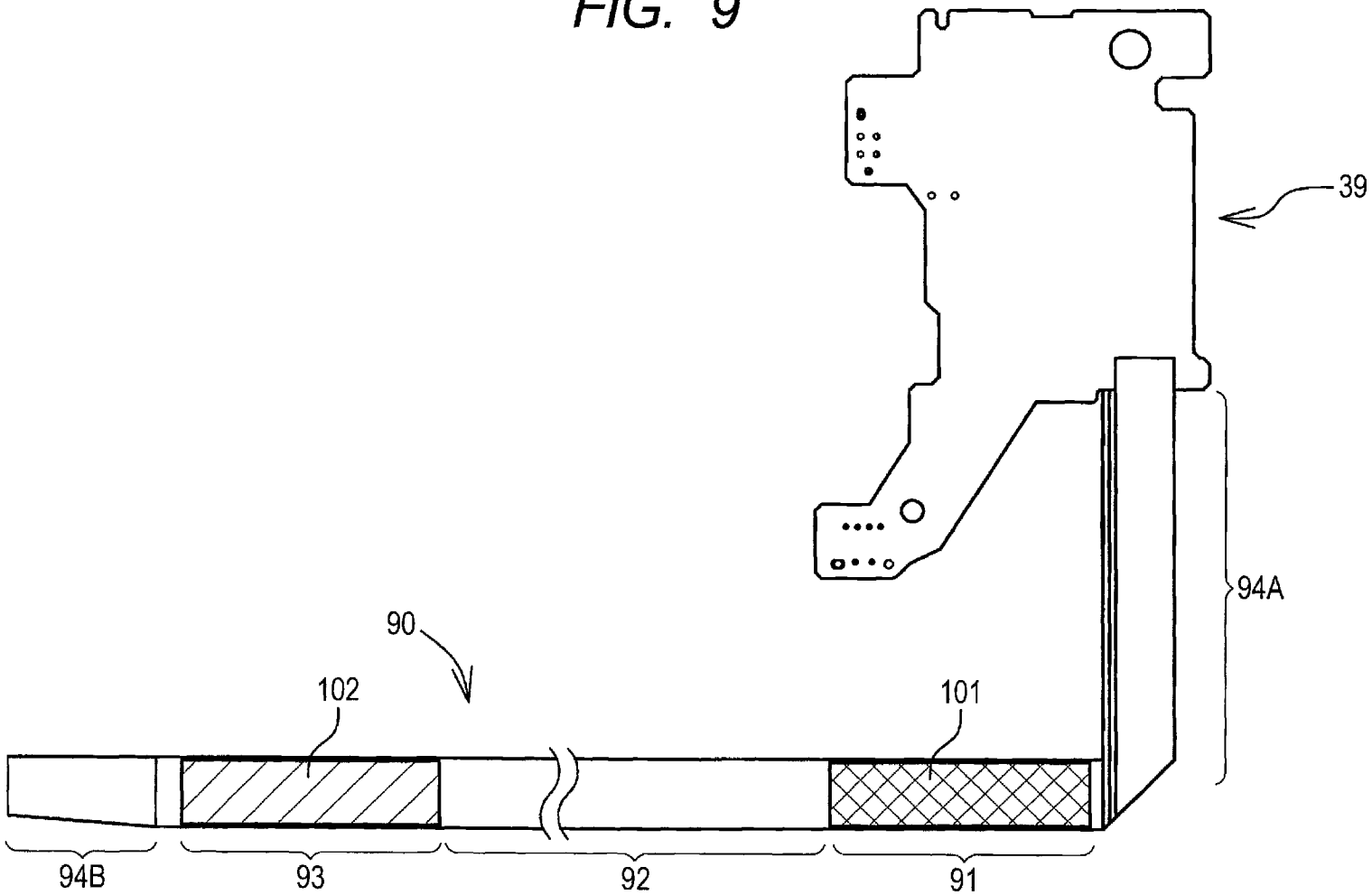
FIG. 9 is a plan view of the flexible flat cable.

In the present embodiment, as shown in FIGS. 7A, 8A, and 9, an aluminum sheet 101, as the reflective sheet, is affixed to a portion of the end portion of the flexible flat cable 90 at the side closer to the carriage 38. In the present embodiment, the aluminum sheet 101 is affixed to a portion of the principal surface of the flexible flat cable 90, the portion confronting the rear-side side wall surface defining the space 73 in a state shown in FIG. 7A and confronting the left-side side wall surface defining the space 73 in a state shown in FIG. 8A.

On the other hand, as shown in FIGS. 7A, 8A, and 9, an electromagnetic-wave absorptive sheet 102 serving both as the reflective sheet and the absorptive sheet is affixed to a portion of the end portion of the flexible flat cable 90 at the fixed end side (the side closer to the control board 80). In the present embodiment, the electromagnetic-wave absorptive sheet 102 is affixed to a portion of the principal surface 90A of the flexible flat cable 90, the portion confronting the front-side side wall surface defining the space 73.

The aluminum sheet 101 is an example of a reflective layer, and is affixed to the flexible flat cable 90 with adhesive or the like. The aluminum sheet 101 reflects electromagnetic waves radiated from the flexible flat cable 90, thereby suppressing the electromagnetic waves leaking to the outside. Note that material constituting the reflective sheet is not limited to aluminum, but may be any material capable of reflecting electromagnetic waves.

The electromagnetic-wave absorptive sheet 102 is an example of a member having both functions of the reflective layer and the absorptive layer. For example, the electromagnetic-wave absorptive sheet 102 is formed by laminating an electromagnetic-wave reflective layer (for example, aluminum foil), an insulating layer, an electromagnetic-wave absorptive layer, and an adhesive layer in this sequence, and by being affixed to the flexible flat cable 90 such that the adhesive layer faces the flexible flat cable 90 side. The electromagnetic-wave absorptive sheet 102 first absorbs part of electromagnetic waves radiated from the flexible flat cable 90 with the electromagnetic-wave absorptive layer, then reflects the electromagnetic waves having passed the electromagnetic-wave absorptive layer with the electromagnetic-wave reflective layer, and again absorbs the electromagnetic waves reflected by the electromagnetic-wave reflective layer with the electromagnetic-wave absorptive layer.

Note that the electromagnetic-wave absorptive sheet 102 is not limited to the above-described configuration, but may be formed by arbitrary combination of any material having electromagnetic-wave reflecting capability and any material having electromagnetic-wave absorbing capability. Alternatively, the electromagnetic-wave absorptive sheet 102 may be formed by a single material having electromagnetic-wave reflecting capability and also having electromagnetic-wave absorbing capability.

In the present embodiment, the aluminum sheet 101 is affixed to the end portion at the side closer to the head board 39 out of the both end portions of the flexible flat cable 90 in the longitudinal direction, and the electromagnetic-wave absorptive sheet 102 is affixed to the end portion at the side closer to the control board 80 (the fixed end). However, the invention is not limited to this example. For example, the aluminum sheet 101 may be affixed to the both end portions. Or, the electromagnetic-wave absorptive sheet 102 may be affixed to the both end portions. Or, the electromagnetic-wave absorptive sheet 102 may be affixed to the end portion at the side closer to the head board 39, and the aluminum sheet 101 may be affixed to the end portion at the side closer to the control board 80.

In the present embodiment, the aluminum sheet 101 and the electromagnetic-wave absorptive sheet 102 as an example of the electrically-conductive sheet are affixed to the flexible flat cable 90. However, a form and a forming method of the electromagnetic-wave reflective layer and the electromagnetic-wave absorptive layer are not limited to this example, as similarly described for the insulating sheet 100.

Material used for absorbing radio waves (electromagnetic wave) includes, for example, a simple substance or a composition of electrically-conductive fiber fabric that absorbs electric current generated by radio waves due to resistance within material, or iron, nickel, ferrite, etc. that absorb radio waves due to magnetic loss of the magnetic material. For example, as a commercial product, AB6000HF series made by 3M Company is taken as an example. Its configuration can be known from a product catalog.

Next, as shown in FIGS. 10A and 10B, in a case where the first through third cables 95, 96, and 97 are bundled to form the flexible flat cable 90, a common-mode noise loop is formed between the cables. Here, when a distance between the cables changes due to movement of the carriage 38, the magnitude of radiation noise changes.

Thus, in the present embodiment, as shown in FIG. 10A, in at least the both end portions of the flexible flat cable 90 in the longitudinal direction, the principal surfaces of the first through third cables 95, 96, and 97 are affixed together with double-faced adhesive tapes 103. As shown in FIGS. 7A, 8A, and 9, the both end portions of the flexible flat cable 90 in the longitudinal direction are, for example, portions at which the aluminum sheet 101 and the electromagnetic-wave absorptive sheet 102 are arranged. A method of bonding the first through third cables 95, 96, and 97 is not limited to the double-faced adhesive tape 103. For example, adhesive may be used, or a tape is wound around the outside of the bundled first through third cables 95, 96, and 97.

On the other hand, in the present embodiment, as shown in FIG. 10B, the first through third cables 95, 96, and 97 are not bonded together in a center portion of the flexible flat cable 90 in the longitudinal direction. As shown in FIGS. 7A, 8A, and 9, the center portion of the flexible flat cable 90 in the longitudinal direction is, for example, a portion between the portions at which the aluminum sheet 101 and the electromagnetic-wave absorptive sheet 102 are arranged. That is, in the center portion of the flexible flat cable 90 in the longitudinal direction, the first through third cables 95, 96, and 97 are allowed to spread/gather in the thickness direction, that is, to spread and come close in the thickness direction with reciprocating movement of the carriage 38.

In the present embodiment, part of ten conductive lines of the first cable 95 (six in the present embodiment) are LVDS conductive lines 98A that transmit LVDS signals, and other conductive lines 98B are connected to GND (ground) potential. For example, two LVDS conductive lines 98A adjacent to each other constitute a pair. A pair of voltages constituting a differential signal is applied to each pair of the LVDS conductive lines 98A (that is, three pairs in the example shown in FIGS. 10A and 10B). The conductive lines 98B located at the both ends and between each pair are connected to the GND potential. Further, of the ten conductive lines of the second cable 96, at least conductive lines 99A, 99B confronting the LVDS conductive lines 98A of the first cable 95 are connected to the GND potential or to a power-source potential. For example, in FIGS. 10A and 10B, the conductive lines 99A located the second and third from the right end are connected to the power-source potential, and the conductive lines 99B are connected to the GND potential.

Advantageous Effects of the Embodiment

According to the present embodiment, the insulating sheet 100 is affixed to the lower surface of the plate 70 confronting the end surface of the flexible flat cable 90. Hence, even if the flexible flat cable 90 vibrates in the upper-lower direction with reciprocating movement of the carriage 38, a direct contact between the end surface of the flexible flat cable 90 and the electrically-conductive plate 70 can be prevented. Consequently, fluctuations of common-mode noise generated between the flexible flat cable 90 and the plate 70 can be suppressed. Further, because the insulating sheet 100 is affixed to the plate 70, not to the flexible flat cable 90, smooth posture changes of the flexible flat cable 90 are not hindered.

Further, according to the present embodiment, radiation noise radiated from the flexible flat cable 90 is reflected by the aluminum sheet 101, so that leaking of radiation noise to the outside is suppressed. This reduces the loop area of common-mode noise generated between the principal surface of the flexible flat cable 90 and the inner wall surface of the frame 72. Additionally, the electromagnetic-wave absorptive sheet 102 suppresses leaking of radiation noise radiated from the flexible flat cable 90 more effectively.

In the present embodiment, the aluminum sheet 101 or the electromagnetic-wave absorptive sheet 102 is selectively affixed to the both end portions of the principal surface of the flexible flat cable 90 in the longitudinal direction, and is not affixed to the center portion. As shown in FIGS. 7A and 8A, the center portion of the flexible flat cable 90 changes its posture greatly, compared with the both end portions. Hence, in order to smoothly change the posture of the flexible flat cable 90, it is preferable that the electrically-conductive sheet be not affixed to the center portion.

If the electrically-conductive sheet is affixed up to a connection with the carriage 38 (more specifically, a position contacting a connector (not shown) connected to the head board 39) of the end portion of the flexible flat cable 90, there is a possibility that the electrically-conductive sheet becomes resistance that hinders changes in the posture of the flexible flat cable 90 and that disturbs movement of the carriage 38. That is, in the present embodiment, the aluminum sheet 101 is preferably affixed to a position away from the connection with the carriage 38 (that is, part of the end portion of the flexible flat cable 90) of the end portion of the flexible flat cable 90 at the carriage 38 side. Similarly, in the present embodiment, the electromagnetic-wave absorptive sheet 102 is preferably affixed to a position away from the connection with the control board 80 (that is, part of the end portion of the flexible flat cable 90) of the end portion of the flexible flat cable 90 at the control board 80 side.

In the present embodiment, the aluminum sheet 101 or the electromagnetic-wave absorptive sheet 102 is affixed to the principal surface of the flexible flat cable 90 formed by bundling the first through third cables 95, 96, and 97, that is, the one of the pair of principal surfaces of the first cable 95 opposite to the principal surface confronting the second cable 96 (the principal surface 90A at the upper side in FIGS. 10A and 10B), or the one of the pair of principal surfaces of the third cable 97 opposite to the principal surface confronting the second cable 96 (the principal surface 90A at the lower side in FIGS. 10A and 10B) in the example of FIGS. 10A and 10B.

However, the position to which the aluminum sheet 101 or the electromagnetic-wave absorptive sheet 102 is affixed is not limited to the above-described example. That is, the aluminum sheet 101 or the electromagnetic-wave absorptive sheet 102 may be further affixed between the first through third cables 95, 96, and 97 laminated together at the both end portions of the flexible flat cable 90. With this configuration, common-mode noise generated between the cables is suppressed.

According to the present embodiment, the first through third cables 95, 96, and 97 are bonded to each other, thereby suppressing changes in intervals between each cable in the thickness direction caused by changes in the posture of the flexible flat cable 90. Consequently, fluctuations of common-mode noise generated between the first through third cables 95, 96, and 97 are suppressed. In a viewpoint of smoothly changing the posture of the flexible flat cable 90, preferably, the first through third cables 95, 96, and 97 are bonded only at the both end portions of the principal surface of the flexible flat cable 90 in the longitudinal direction, and are not bonded at the center portion.

In the present embodiment, it should be understood that the end portion of the flexible flat cable 90 in the longitudinal direction is not limited to a so-called terminal end, but encompasses a predetermined region including the terminal end. For example, as shown in FIG. 9, the flexible flat cable 90 is divided into a pair of end regions 91, 93 and a center region 92 located between the pair of end regions 91, 93. The aluminum sheet 101 or the electromagnetic-wave absorptive sheet 102 is affixed to an entirety or part of the pair of end regions 91, 93, for example. Similarly, the first through third cables 95, 96, and 97 are bonded together in an entirety or part of the pair of end regions 91, 93, for example.

Here, a ratio of the pair of end regions 91, 93 to the entire length of the flexible flat cable 90 and a ratio of the center region 92 to the entire length of the flexible flat cable 90 are not limited to specific values. As an example, however, a range of approximately 5-15% of the entire length of the flexible flat cable 90 from the end at the head board 39 side is defined as the end region 91, a range of approximately 5-15% of the entire length of the flexible flat cable 90 from the end at the control board 80 (fixed end) side is defined as the end region 93, and a range of approximately 70-90% of the entire length of the flexible flat cable 90 interposed between the end regions 91, 93 is defined as the center region 92.

Note that the ratios of the end regions 91, 93 and the center region 92 are not limited to the above-described example and, for example, are determined by considering a balance between radiation noise suppression and smooth posture change of the flexible flat cable 90. That is, if weight is put on radiation noise suppression, the ratios of the end regions 91, 93 may be determined to be relatively large. And, if weight is put on smooth posture change of the flexible flat cable 90, the ratios of the end regions 91, 93 may be determined to be relatively small.

In the flexible flat cable 90 shown in FIG. 9, a connection region 94A extending from the head board 39 is a portion fixed to the inside of the carriage 38 so as to be connected to the head board 39. Also, a connection region 94B is a portion fixed to the frame 72, so as to be connected to the control board 80. Hence, in the present embodiment, the pair of end regions 91, 93 and the center region 92 are defined assuming that the entire length of the flexible flat cable 90 is a region from a position exposed to the outside of the carriage 38 to a position fixed to the frame 72 (that is, a region excluding the connection regions 94A and 94B) of the flexible flat cable 90 shown in FIG. 9.

Further, according to the present embodiment, the conductive lines 99A, 99B of the second cable 96 proximate to the LVDS conductive lines 98A having large radiation noise are used for GND or for the power source, and other control signals are not transmitted through the conductive lines 99A, 99B. With this configuration, even in a case where the first through third cables 95, 96, and 97 are bonded with the double-faced adhesive tape 103, the common mode loop between the cables is made small so that radiation noise can be suppressed.

While the invention has been described in detail with reference to the above aspects thereof, it would be apparent to those skilled in the art that various changes and modifications may be made therein without departing from the scope of the claims.

In the present embodiment, the measure for radiation noise of the flexible flat cable 90 has been described in detail. Also, a measure for radiation noise may be taken for a plurality of harnesses (not shown) extending from the control board 80. Specifically, because high-frequency signals in the LVDS method are transmitted through a harness connecting the control board 80 and the fixed end of the flexible flat cable 90, there is a possibility that common-mode noise is generated between this harness and another harness extending from the control board 80. Hence, a shielding film may be provided between the harness connected to the flexible flat cable 90 and the other harness, out of the plurality of harnesses extending from the control board 80.

For example, the shielding film may be a type that physically isolates the harness located at one side of the shielding film from the harness located at the other side of the shielding film, or may be a type that blocks radiation noise radiated from the harnesses. With this configuration, because the harness connected to the flexible flat cable 90 and the other harness are separated, common-mode noise generated between these harnesses is suppressed.

In the present embodiment, an example has been described in which the carriage 38 moves reciprocatingly in one direction that is a horizontal direction (an example of the scanning direction), and the flexible flat cable 90 is disposed such that its end surface faces in the gravitational direction (an example of a direction intersecting the scanning direction). However, the invention is not limited to the above-described example, and could be applied to arbitrary combination of two directions intersecting (for example, perpendicular to) each other. Further, the direction of reciprocating movement of the carriage 38 (scanning direction) and the direction in which the end surface of the flexible flat cable 90 faces may be in a non-intersecting relationship.

What is claimed is:

1. An image recording apparatus comprising:

a control board;

a recording head configured to selectively eject ink droplets from nozzles;

a head board configured to control the recording head to operate based on a high-frequency signal outputted from the control board;

a carriage configured to move in a reciprocating manner, with the recording head and the head board mounted thereon; and a belt-like cable connecting the control board and the head board so that the high-frequency signal can be transmitted therebetween, the cable having such flexibility that the cable can change a posture following reciprocating movement of the carriage, the cable having a first surface facing in a thickness direction of the cable, the first surface having a first end portion and a second end portion with respect to a longitudinal direction of the first surface, a first sheet affixed to a part of the first end portion by an adhesive material, the first sheet having such flexibility that the first sheet can change shape following reciprocating movement of the carriage, and a second sheet affixed to a part of the second end portion by the adhesive material, the second sheet having such flexibility that the second sheet can change shape following reciprocating movement of the carriage, wherein each of the first sheet and the second sheet has a reflective layer configured to reflect an electromagnetic wave.

2. The image recording apparatus according to claim 1, wherein the cable further has an absorptive layer at at least one of the first end portion and the second end portion, the absorptive layer being configured to absorb an electromagnetic wave.

3. The image recording apparatus according to claim 1, wherein the first end portion is an end portion at a side of the control board, and the second end portion is an end portion at a side of the head board; and wherein the reflective layer at the second end portion is provided at a position spaced away from a connection between the head board and the cable.

4. The image recording apparatus according to claim 1, wherein the cable comprises belt-like first and second cables; and wherein the first and second cables are bonded to each other at at least the first end portion and the second end portion in such a manner that the first and second cables overlap each other in the thickness direction.

5. The image recording apparatus according to claim 4, wherein the control board is configured to transmit the high-frequency signal in an LVDS (Low Voltage Differential Signaling) method to the head board through the first cable.

6. The image recording apparatus according to claim 5, wherein each of the first cable and the second cable has a plurality of conductive lines;

wherein a part of the plurality of conductive lines included in the first cable is an LVDS conductive line configured to transmit a signal in the LVDS method; and wherein a part of the plurality of conductive lines included in the second cable is connected to one of a ground potential and a power-source potential, the part of the plurality of conductive lines included in the second cable confronting the LVDS conductive line in the thickness direction.

7. The image recording apparatus according to claim 1, further comprising a conductive frame supporting the control board and supporting the carriage to be movable in a reciprocating manner, the frame having an inner space in which the cable is disposed, the cable having second surfaces facing in a width direction of the cable, wherein the frame has inner surfaces confronting the second surfaces of the cable, and an insulating layer is provided on at least one of the inner surfaces.

8. The image recording apparatus according to claim 2, wherein at least one of the first sheet and the second sheet comprises the absorptive layer.

9. The image recording apparatus according to claim 7, wherein the insulating layer comprises an insulating sheet that is affixed to the at least one of the inner surfaces of the frame.

10. The image recording apparatus according to claim 4, wherein the first and second cables are not bonded to each other in a center portion with respect to the longitudinal direction, the center portion being a portion between the first end portion and the second end portion.

11. The image recording apparatus according to claim 1, wherein the first end portion is an end portion at a side of the control board and the second end portion is an end portion at a side of the head board;

wherein the part of the first end portion is different from a part fixed to the control board so that the part of the first end portion can change shape following reciprocating movement of the carriage; and wherein the part of the second end portion is different from a part fixed to the head board so that the part of the second end portion can change shape following reciprocating movement of the carriage.

* * * * *